US011207879B2

(12) United States Patent
Hirukawa et al.

(10) Patent No.: US 11,207,879 B2
(45) Date of Patent: Dec. 28, 2021

(54) SCREEN PRINTER

(71) Applicant: FUJI CORPORATION, Chiryu (JP)

(72) Inventors: Ritsuo Hirukawa, Nishio (JP); Yoji Fujita, Okazaki (JP); Takeshi Kondo, Chiryu (JP); Shoji Fukakusa, Yokkaichi (JP); Yoshimune Yokoi, Kiyosu (JP); Naoki Matsuzaki, Nishio (JP)

(73) Assignee: FUJI CORPORATION, Chiryu (JP)

( * ) Notice: Subject to any disclaimer, the term of this patent is extended or adjusted under 35 U.S.C. 154(b) by 648 days.

(21) Appl. No.: 16/077,977

(22) PCT Filed: Feb. 24, 2016

(86) PCT No.: PCT/JP2016/055369
§ 371 (c)(1),
(2) Date: Aug. 14, 2018

(87) PCT Pub. No.: WO2017/145280
PCT Pub. Date: Aug. 31, 2017

(65) Prior Publication Data

US 2021/0016558 A1 Jan. 21, 2021

(51) Int. Cl.
*B41F 15/44* (2006.01)
*B41F 15/26* (2006.01)

(52) U.S. Cl.
CPC ..... *B41F 15/44* (2013.01); *B41F 15/26* (2013.01)

(58) Field of Classification Search
CPC .... B41F 15/08; B41F 15/088; B41F 15/0845; B41F 15/085; B41F 15/16; B41F 15/18;
(Continued)

(56) References Cited

U.S. PATENT DOCUMENTS

2005/0155501 A1* 7/2005 Sakaue ..... B41F 15/22 101/126
2007/0214976 A1* 9/2007 Mizuno ..... H05K 3/1216 101/129

(Continued)

FOREIGN PATENT DOCUMENTS

JP 2-158192 A 6/1990
JP 07-040524 * 2/1995 ..... B41F 15/08

(Continued)

OTHER PUBLICATIONS

Extended European Search Report dated Oct. 18, 2018 in Patent Application No. 16891437.2, citing documents AA and AO therein, 8 pages.

(Continued)

*Primary Examiner* — Matthew G Marini
*Assistant Examiner* — Marissa Ferguson-Samreth
(74) *Attorney, Agent, or Firm* — Oblon, McClelland, Maier & Neustadt, L.L.P.

(57) ABSTRACT

There is provided a screen printer including: a squeegee device for spreading a cream solder over a mask having formed thereon a printing pattern configured of a plurality of through holes to force the cream solder through the printing pattern; a clamping device for holding a board that is conveyed to be placed under the mask; and a lift device for disposing the board with respect to the mask in relation to a vertical direction, wherein the clamping device includes a pair of clamping portions for holding the board therebetween from a width direction, wherein the pair of clamping portions includes individually detachable clamping members that are brought into abutment with lateral end faces of the board, and wherein the clamping members individually have two or more clamping surfaces that are brought into
(Continued)

abutment with the board in such a way that the clamping surfaces can be converted.

5 Claims, 9 Drawing Sheets

(58) Field of Classification Search
CPC ..... B41F 15/20; B41F 15/26; B41F 15/36; B41F 15/44; B41F 15/46; H05K 3/1216; H05K 3/1225; H05K 3/1233
See application file for complete search history.

(56) References Cited

U.S. PATENT DOCUMENTS

| | | | | |
|---|---|---|---|---|
| 2013/0061766 | A1* | 3/2013 | Mizuno | H05K 3/1233 101/126 |
| 2019/0224960 | A1* | 7/2019 | Kato | H05K 3/1216 |
| 2019/0351670 | A1* | 11/2019 | Kato | B41F 15/0881 |

FOREIGN PATENT DOCUMENTS

| | | | | |
|---|---|---|---|---|
| JP | 2006-289817 | * | 10/2006 | B41F 15/40 |
| JP | 2006-289817 | A | 10/2006 | |
| JP | 2010-0056182 | * | 3/2010 | H05K 3/34 |
| JP | 2011-126078 | A | 6/2011 | |

OTHER PUBLICATIONS

International Search Report dated May 24, 2016, in PCT/JP2016/055369 filed Feb. 24, 2016.

* cited by examiner

SCREEN PRINTER

TECHNICAL FIELD

The present application relates to a screen printer for printing a cream solder on a board, and more particularly to a screen printer characterized by a clamping structure for fixing the board in place.

BACKGROUND ART

In a screen printer, a screen mask having a printing pattern (through holes for printing) is held inside a printer body, and a board, conveyed by a board conveyance device, is placed below the screen mask. Then, screen printing using a cream solder is performed on the board. In addition to the board conveyance device, the screen printer includes a board holding device for holding the conveyed board to dispose the conveyed board at a printing position, a screen mask holding device for disposing and holding the screen mask, and further a squeegee device for spreading the cream solder over an upper surface of the screen mask.

A line of paste-like cream solder is supplied onto the screen mask in a width direction, and the plate-shaped squeegee moves in a front and rear direction orthogonal to the width direction of the cream solder. Then, the squeegee forces the cream solder into the printing pattern while rolling it over the screen mask, thereby printing the cream solder onto the underlying board. In the screen printing using the cream solder, the board is disposed at the printing position directly below the screen mask. As a fixing method of fixing the board in place, a top clamping method and a side clamping method are known. In the top clamping method, an edge portion of the board is pressed down from thereabove, and an underside of the board is supported wholly, whereby the board is clamped vertically. On the other hand, in the side clamping method, the board is gripped so as to be held sideways from a horizontal direction.

PRIOR ART

Patent Document

Patent Document 1: JP-A-2011-126078

BRIEF SUMMARY

Technical Problem

In a screen printer of Patent Document 1, different types of clamping members are prepared to use, namely both the top clamping method and the side clamping method, so that the clamping members can be replaced depending upon the contents of printing to be done on the board. However, preparing a plurality of clamping members that can be adopted to the top clamping method and the side clamping method is likely to increase the number of parts, which turns out increasing production costs or labor cost for storing the clamping members. Further, the conventional screen printer has a problem with the service life of the clamping members. FIG. 8 is a schematic diagram showing how to clamp a board when it is clamped.

A board 100 is lifted up by a backup mechanism 102 to be disposed between a pair of clamping members 101. As this occurs, to restore the board 100 that is curved downward as illustrated to a horizontal state, for example, end portions of the board 100 that is being lifted up are caused to slide on the clamping members 101. This is because it is considered that when the end portions of the board 10 slide on the clamping members, the end portions move slower than a central portion of the board 100 due sliding resistance to thereby eliminate the downward curving of the board 100. However, when the clamping members 101 are brought into sliding contact with the board 100 in a repeated fashion, clamping surfaces of the clamping members 101 wear, thereby reducing the service life of the clamping members 101. More overly, when the clamping surfaces wear, the board 100 tends to deviate from the proper printing position when it is clamped by the clamping members 101, causing a reduction in printing accuracy.

Then, an object of the disclosure is to provide a screen printing machine including a clamping member whose clamping surfaces can be converted.

Means for Solving the Problem

According to an aspect of the disclosure, there is provided a screen printer including a squeegee device for spreading a cream solder over a mask having formed thereon a printing pattern configured of a plurality of through holes to force the cream solder through the printing pattern, a clamping device for holding a board that is conveyed to be placed under the mask and a lift device for vertically disposing the board with respect to the mask, wherein the clamping device includes a pair of clamping portions for holding the board therebetween from a width direction, wherein the pair of clamping portions include individually detachable clamping members that are brought into abutment with lateral end faces of the board, and wherein the clamping members individually have two or more clamping surfaces that are brought into abutment with the board.

Advantageous Effect

According to the screen printer of the disclosure, the board is clamped from the width direction by the clamping device using the pair of clamping portions. Then, the clamping members of the clamping portions that are brought into abutment with the board are detachable, and the two or more clamping surfaces are formed individually on the clamping members. Thus, the clamping surfaces can be converted. Therefore, in case of the two or more clamping surfaces being clamping surfaces of different types, both the side clamping method and the top clamping method can be adopted. On the other hand, in case the two or more clamping surfaces are clamping surfaces of the same type, the service life of the clamping members can be more extended.

DETAILED DESCRIPTION

Figure 1:
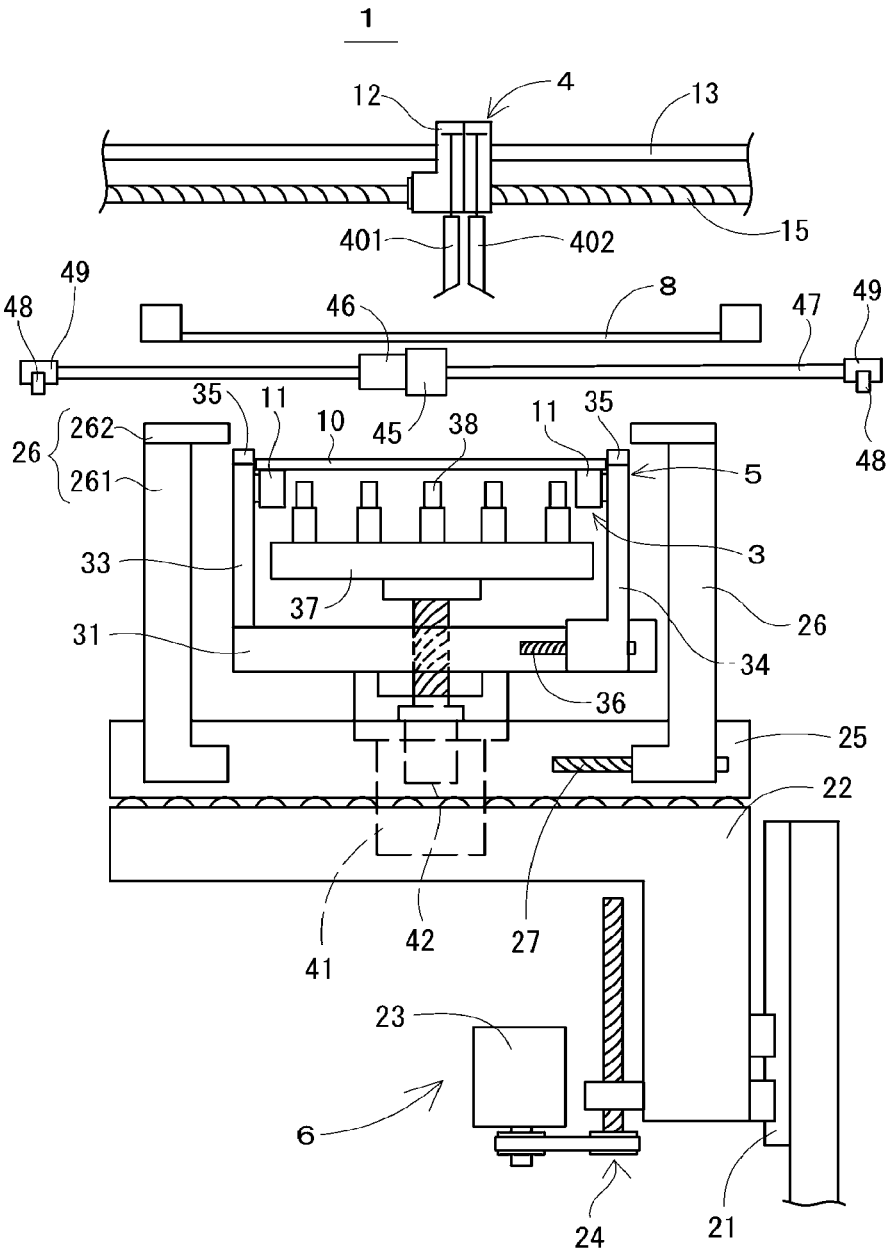
FIG. 1 is a diagram schematically showing an internal configuration of an embodiment of a screen printer.

Next, an embodiment of a screen printer according to the disclosure will be described below by reference to the drawings. FIG. 1 is a diagram schematically showing an internal configuration of a screen printer according to the embodiment. The screen printer 1 is configured as a front-end process before a component mounting machine mounts electronic components on a board. The screen printer 1 includes a board conveyor device 3, a squeegee device 4, a clamping device 5 for holding a board, and a lift device 6 for disposing the board in relation to a vertical direction. Then, a control device is installed on the screen printer 1 to control it entirely, and respective driving modules of the devices are controlled in predetermined manners.

In the screen printer 1, a board 10 is conveyed in and out by the board conveyor device 3. The conveyor device 3 has a pair of conveyor belts 11 that support both sides of the board 10, and the board 10 is fed in a normal direction of the sheet of paper on which FIG. 1 is drawn (i.e., in a width direction of a printer body). Then, the board conveyance device 3 and the clamping device 5 for holding the board 10 are assembled to the lift device 6. Therefore, when the board 10 is conveyed to the screen printer 1, the board 10 is held by the clamping device 5 and is lifted up to a printing position directly below a mask 8. The mask 8 is fitted in a rectangular frame member and is fixed in a horizontal state.

A line of cream solder is supplied onto the mask 8 set in place in the width direction of the printer body. The cream solder is spread over the mask 8 to be forced through a printing pattern while being rolled by the squeegee device 4 and is then applied to the board 10 located underneath the mask 8. The squeegee device 4 is mounted on a carriage 12 in such a state that a pair of squeegee heads 401 and 402 each having a squeegee can be lifted up and down by cylinders. The carriage 12 is slidably assembled to a guide rod 13 provided to extend in a horizontal direction in FIG. 1 (a front and rear direction of the printer body) and is capable of moving rectilinearly in the horizontal direction. A screw shaft 15 is provided rotatably on the screen printer 1 in such a way as to extend parallel to the guide rod 13 and is rotated by a drive motor. A ball screw mechanism is configured of a nut fixed inside the carriage 12 and the screw shaft 15.

Next, to hold and position the board 10 in place, the board conveyance device 3, the clamping device 5, the lift device 6 and the like are provided below the set mask 8. Firstly, in the lift device 6, a lifting table 22 is assembled so as to slide along a vertical guide rail 21, and the lifting table 22 is connected to a lifting motor 23 via a ball screw mechanism 24. Then, the board conveyor device 3, the clamping device 5 and the like are mounted on the lifting table 22 via a support table 25. Although a detailed description is omitted here, the support table 25 is capable of adjusting its position in an X direction, a Y direction and a θ direction on an X-Y plane with respect to the lifting table 22.

A pair of mask supports 26 are disposed on the support table 25 in the front and rear direction of the printer body, and the clamping device 5 is disposed between the mask supports 26. The pair of mask supports 26 disposed at the front and rear direction include individually portal leg members 261 in the width direction of the printing machine body and mask supporting plates 262 fixed individually to upper surfaces of the leg members 261 for contact with the mask 8. One of the mask supports 26 includes a ball screw mechanism configured of a fixed nut inside the leg member 261 and a screw shaft 27 that is in a thread engagement with the fixed nut. Therefore, a distance between this mask support 26 and the other mask support 26 can be controlled by controlling a drive motor for rotating the screw shaft 27.

In the clamping device 5, a pair of side frames 33, 34 are disposed at the front and rear of a support table 31, and the side frame 34 includes a ball screw mechanism configured of a fixed nut therein and a screw shaft 36 that is in thread engagement with the fixed nut. A distance between the side frames 33, 34 can be controlled by driving a clamping motor for rotating the screw shaft 36. Then, clamping portions 35 are formed at upper end portions of the side frames 33, 34, and the board 10 can be gripped by controlling a distance therebetween. The conveyor belts 11 are assembled to lower sides of the clamping portions 35 of the side frames 33, 34, whereby the board conveyance device 3 for conveying the board 10 is disposed between the side frames 33 and 34.

A backup mechanism is provided between the side frames 33, 34. The backup mechanism includes a plurality of backup pins 38 that are attached to a backup table 37 so as to avoid electronic components that are to be mounted on the board 10. The support table 31 of the clamping device 5 is supported via a ball screw mechanism that converts a rotational output of a lifting motor 41 into a lifting motion. Further, a lifting motor 42 is fixed to the support table 31, and the backup table 37 is supported via a ball screw mechanism that converts a rotational output of the lifting motor 42 into a lifting motion.

In the screen printer 1 configured as described above, the board 10 is conveyed in between the side frames 33, 34 by the conveyor belts 11. Then, the backup table 37 is lifted up by driving the lifting motor 42, whereby the board 10 is thrust up by the backup pins 38 to thereby be lifted up from the conveyor belts 11. The side frame 34 moves as a result of the screw shaft 36 being rotated, whereby the board 10 is held by the clamping portions 35 of the side frames 33, 34 therebetween.

Then, when the lifting motor 41 is driven, the entire clamping device 5 that is holding the board 10 is lifted up, and the clamping portions 35 and the board 10 are aligned in height with the mask supporting plates 262 so that upper surfaces thereof are aligned in height with one another. Thereafter, the lifting table 22 is lifted up by driving the lifting motor 23 and stops in a printing position where the upper surfaces of the mask supporting plates 262, the clamping portions 35 and the board 10 are brought into light contact with a lower surface of the mask 8. On the other hand, on an upper surface side of the mask 8, the supplied cream solder is spread over the mask 8 to be forced through the printing pattern while being rolled by the squeegee device 4. As a result, the cream solder passes through the through holes of the printing pattern to be printed on the board 10 that is disposed underneath the mask 8.

Figure 8:
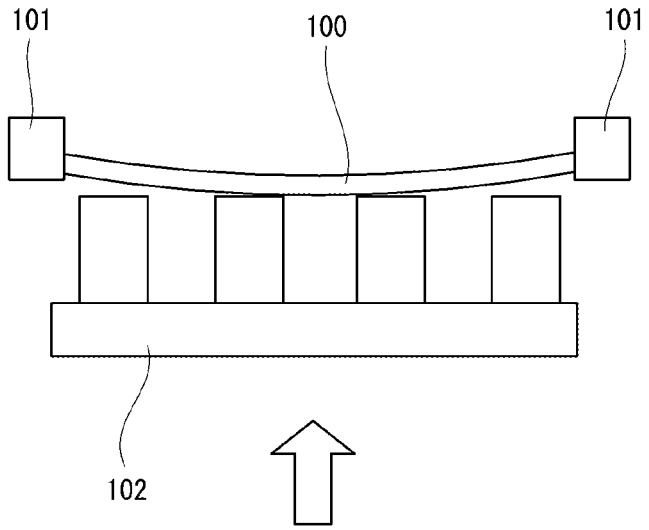
FIG. 8 Related Art
FIG. 8 is a schematic diagram showing a state where aboard is clamped.

Incidentally, in lifting up the board 10 using the backup pins 38, including a case where the downward curving of the board 100 is eliminated as shown in FIG. 8, the distance between the side frames 33, 34 is controlled in advance so that end faces of the board 10 are brought into sliding contact with the clamping portions 35. Therefore, as described in the technical problem, the sliding contact calls for a reduction in service life of the clamping portions 35 due to wear. Then, in this embodiment, instead of replacing clamping portions 35 entirely as a disposable part, the clamping portions 35 each include a separate clamping member configured to be brought into direct contact with the board 10 to hold it. Further, in this embodiment, the clamping member is configured not only to be separable from the clamping portion 35 but also to have a longer service life or a multiplicity of functions. Therefore, firstly, the clamping member will be described that is configured to have a multiplicity of functions.

Figure 2:
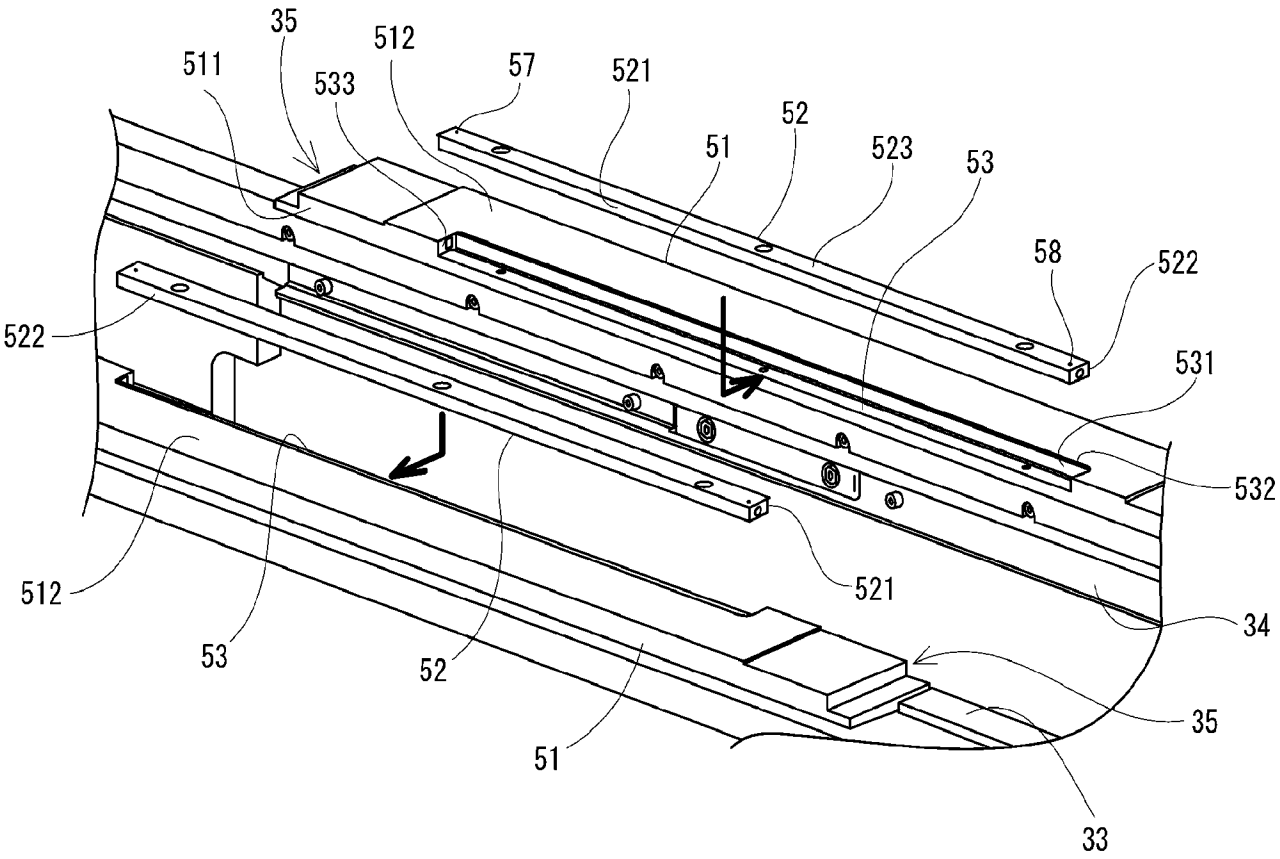
FIG. 2 is a perspective view showing clamping portions of the screen printer.

FIG. 2 is a perspective view showing the clamping portions 35 of the embodiment. The clamping portions 35 of the side frames 33, 34 have the same configuration and are disposed symmetrically. In the clamping portions 35, base blocks 51 are fixed on to the side frames 33, 34, and clamping bars 52 can detachably be mounted on the base blocks 51. A detachably mounting recessed portion 53 is formed on an inner side of each of the base blocks 51 that faces the opposite side frame 33 or 34 in an upper position, and the clamping bar 52 is then fitted in the detachably mounting recessed portion 53 as indicated by an arrow so that the clamping bar 52 can be screwed down therein.

Figure 3:
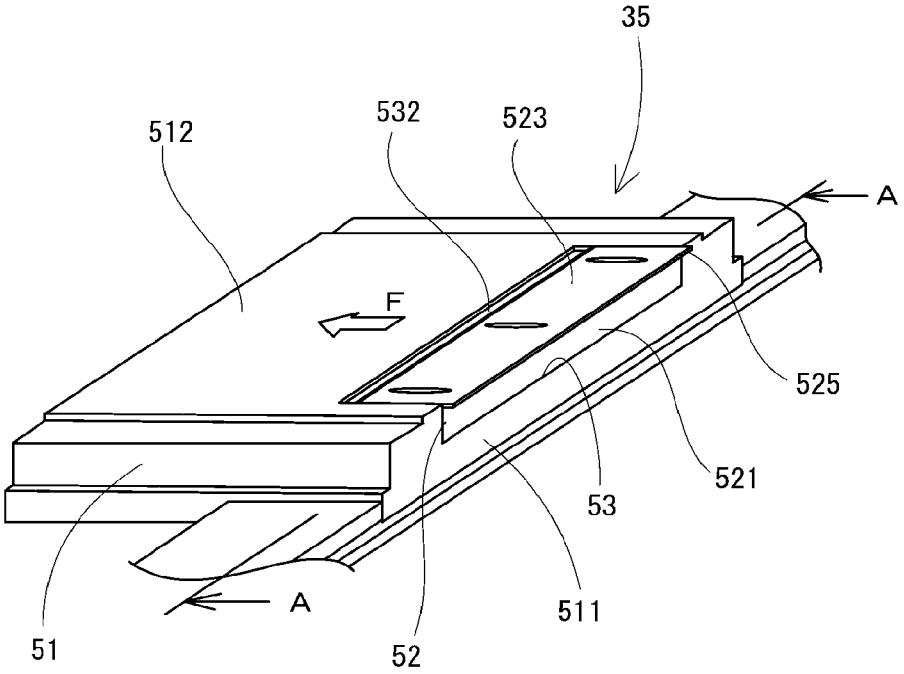
FIG. 3 is a perspective view showing the clamping portion with a top clamping surface provided thereon.
Figure 4:
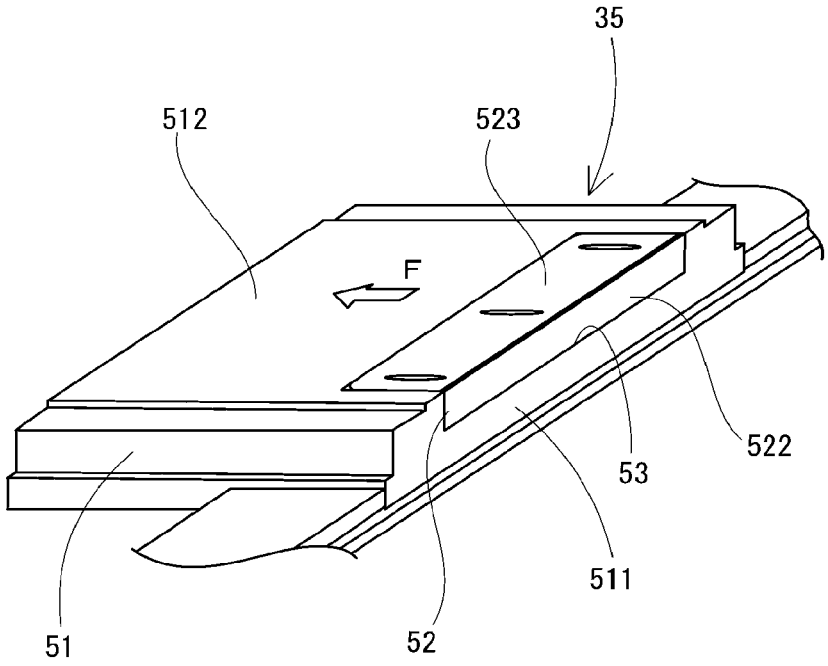
FIG. 4 is a perspective view showing the clamping portion with a side clamping surface provided thereon.

When clamping the board 10, clamping surfaces of the clamping bars 52 are brought into direct abutment with the board 10. In this embodiment, the clamping bar 52 includes a plurality of clamping surfaces formed thereon, and specifically speaking, two types of clamping surfaces are formed on the clamping bar 52 so that the clamping bar 52 can function in two ways. Specifically, the clamping bar 52 includes a top clamping surface 521 and a side clamping surface 522. FIGS. 3 and 4 are perspective views showing the clamping portion 35, and a scale in a width direction is shown larger in comparison with a scale in a longitudinal direction for the sake of easy understanding. FIG. 3 shows a case where the top clamping surface is used, and FIG. 4 shows a case where the side clamping surface is used.

The clamping bar 52 is a bar-shaped member having a rectangular cross section, and the side clamping surface 522 is formed on an opposite side to the side where the top clamping surface 521 is formed. Further, a flange portion 525 is formed on an upper surface of the clamping bar 52 so as to protrude towards the side where the top clamp surface 521 is formed. The clamping bar 52 is fitted in the detachably mounting recessed portion 53 of the base block 51 in a direction indicated by an arrow F, and as shown in FIG. 2, the detachably mounting recessed portion 53 has a shape matching that of the clamping bar 52 by cutting out an upper corner portion of the base block 51.

When the top clamping surface 521 is used, the clamping bar 52 is fitted in the detachably mounting recessed portion 53 so that the side clamping surface 522 abuts against a deeper side wall surface 531 thereof. On the other hand, when the side clamping surface 522 is used, the clamping bar 52 is fitted in the detachably mounting recessed portion 53 so that the top clamping surface 521 abuts against the deeper side wall surface 531 thereof. A step portion 532 is formed in an upper portion of the deeper side wall surface 531 so that the flange portion 525 fits therein. Then, a bolt passing through the clamping bar 52 from an upper side thereof is fastened to the base block 51. As this occurs, the top clamping surface 521 or the side clamping surface 522 is substantially flush with an inner surface 511 of the base block 51. Upper surfaces 523, 512 of the clamping bar 52 and the base block 51 are configured to be at the same height.

Incidentally, since there is some allowance in bolt holes formed in the clamping bar 52, there may be a case where the clamping bar 52 protrudes by an amount corresponding to the amount of allowance. In the cases where the top clamping surface 521 and the side clamping surface 522 protrude from the inner surface 511 of the base block 51, an end portion of the board 10 is caught by the protruding clamping bar 52 when the board 10 is lifted up by the backup pins 38. An operator of the screen printer 1 needs to be careful to mount the clamping bar 52 in the detachably mounting recessed portion 53 properly because the board 10 can be caught even by a slight step. However hard the operator attempts to mount the clamping bar 52 properly, a mounting error may still occur. Therefore, in this embodiment, a configuration is adopted which can avoid such a mounting error.

Figure 5:
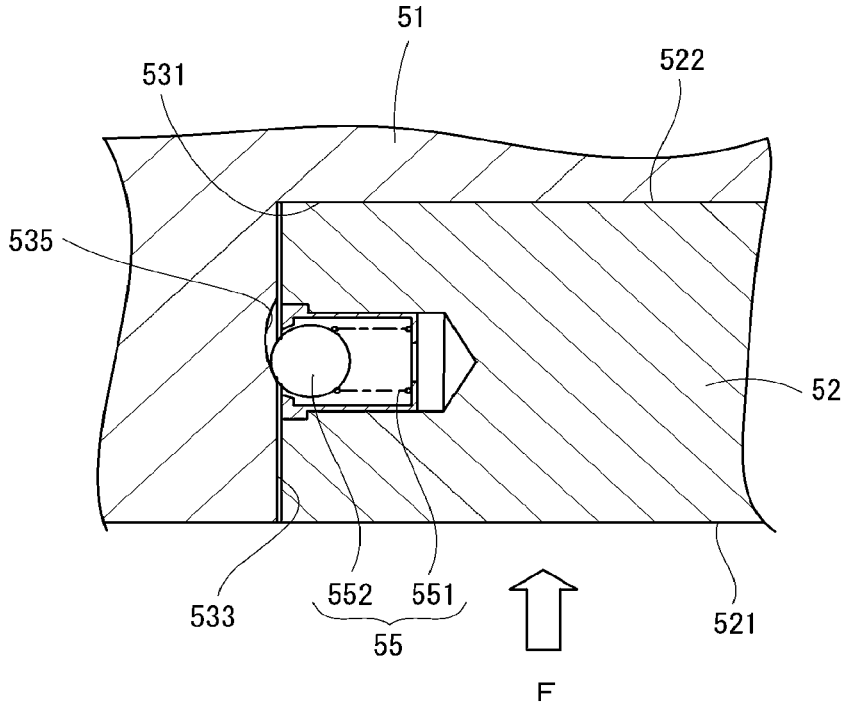
FIG. 5 is a sectional view taken along a line A-A in FIG. 3 showing one longitudinal end portion of a clamping bar.

FIG. 5 is a sectional view of a longitudinal end portion of the clamping bar 52, taken along a line A-A and seen from a direction indicated by arrows in FIG. 3. The clamping bar 52 is fitted in the detachably mounting recessed portion 53 in the direction indicated by the arrow F with longitudinal lateral surfaces thereof directed in the front and rear direction (refer to FIGS. 3, 4). Then, the clamping bar 52 has ball plungers 55 provided in the longitudinal end portions thereof. The ball plungers 55 are mounted individually in horizontal holes formed in the end portions of the clamping bar 52, and balls 552 are biased by springs 551 to thereby project partially out of the horizontal holes. On the other hand, depressions 535 are formed on the base block 51 so that the balls 552 enter longitudinal end wall surfaces 533 of the detachably mounting recessed portion 53. The depressions 535 are each formed into a spherical surface that is larger in diameter than the ball 552 so that the ball 552 enters only partially the depression 535 with the clamping bar 52 mounted properly as shown in the figure.

Namely, when the operator fits the clamping bar 52 into the detachably mounting recessed portion 53, the balls 552 are disposed immediately before deepest portions of the spherical depressions 535, whereby the balls 552 are each subjected to a reaction force from an inclined surface of the depression 535. Then, a component of the reaction force exerted in the direction indicated by the arrow F serves as a force for pressing the clamping bar 52 in the fitting direction. As a result of such a force acting on both the end portions of the clamping bar 52, the top clamping surface 521 or the side clamping surface 522 that is not in use is caused to abut against the deeper side wall surface 531 strongly, whereby the clamping bar 52 is fitted properly. It should be noted that the depressions 535 are to apply the reaction force in the fitting direction indicated by the arrow F to the clamping bar via the balls 552, and thus the depressions 535 may be formed not into the spherical surface but into a flat surface.

Figure 6:
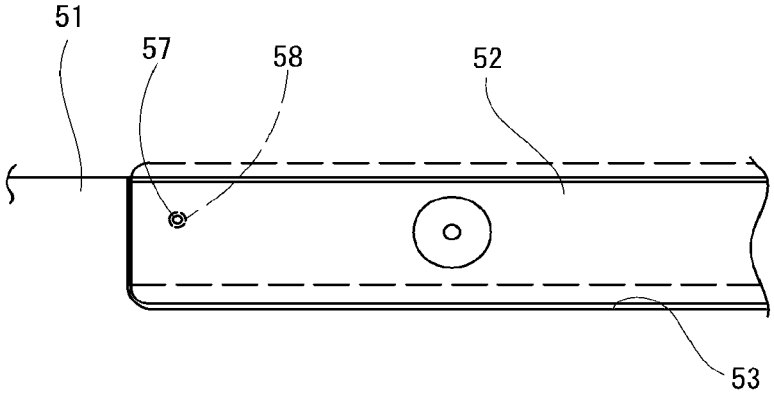
FIG. 6 is a plan view showing an end portion of the clamping bar attached to a base block.

The clamping portions 35 can convert the two modes of use of two patterns as shown in FIG. 3 or 4 as a result of the operator who fits the clamping bar 52 into the detachably mounting recessed portion 53 after selecting the top clamping surface 521 or the side clamping surface 522 for use. However, as this occurs, it is possible for a mounting error to occur in which the clamping bar 52 is mounted with the clamping surface selected for use not disposed properly or as required. To avoid such a drawback, in this embodiment, identification marks 57 and 58 shown in FIG. 2 are attached to the clamping bar 52. Here, FIG. 6 is a plan view showing an end portion of the clamping bar 52 mounted on the base block 51, in which a state where the clamping bar 52 is mounted with the side clamping surface 522 selected for use is indicated by a solid line while a state where the clamping bar 52 is mounted with the top clamping surface 521 selected for use is indicated by a broken line. Namely, in this embodiment, as shown in FIG. 6, even though the clamping bar 52 is mounted on the base block 51 in either of the two modes of use, the identification marks 57, 58 are located in the same positions.

As shown in FIG. 1, the screen printer 1 includes a camera 45. The camera 45 captures images of the identification marks 57, 58 and other marks attached to the board 10 and the mask 8. The camera 45 is mounted on a guide rail 47 extending in the front and rear direction of the printing machine body via a slider 46 so as to move along the guide rail 47. The guide rail 47 is provided to extend between two guide rails 48 extending in a width direction of the printing machine body via sliders 49. The identification marks 57, 58 attached to the clamping bar 52 have different sizes. Therefore, which of the top clamping surface 521 and the side clamping surface 522 is used at the clamping portion 35 is determined by capturing the image of the identification mark 57 or 58 with the camera 45 and processing the captured image before a start of printing.

Subsequently, in holding the board 10, in the case of the top clamping surface 521 being used, the board 10 is pushed up from therebelow by the backup pins 38 to be brought into abutment with the flange portions 525 at end portions of an upper surface thereof. Then, the board 10 is gripped by the clamping portions 35 while being held by the pair of top clamping surfaces 521 therebetween. Therefore, the top clamping surfaces 521 are effective in holding the board 10 in a horizontal state even when the board 10 curves as shown in FIG. 8. However, when the top clamping surfaces 521 are used at the clamping portions 35, a gap corresponding to a thickness of the flange portion 525 is generated between the board 10 and the mask 8. On the other hand, when the side clamping surfaces 522 are used at the clamping portions 35, since the upper surface of the board 10 is aligned with the upper surfaces of the clamping portions 35, no gap is generated between the board 10 and the mask 8. However, with the board 10 curving downward as shown in FIG. 8, since the board 10 is not fastened or pressed down from thereabove, the board 10 is caused to curve more by being held by the side clamping surfaces 522 therebetween, whereby it becomes difficult to hold the board 10 in the horizontal state.

In this way, the top clamping method and the side clamping method have their advantages and disadvantages, respectively, and therefore, the methods need to be selectively used depending upon types and conditions of boards used for fabrication of final products. In this regard, in this embodiment, the clamping portions 35 can be converted to either of the two modes of use extremely easily only by changing the ways of mounting the clamping bars 52 on the clamping portions 35. In addition, since only the ways of mounting the clamping bars 52 on the clamping portions 35 have to be changed, changing the clamping methods is easy, and it is possible to reduce the number of parts involved, leading to a reduction in production costs.

Further, in mounting the clamping bar 52, the balls 552 of the ball plungers 55 enter the depressions 535 to generate the reaction force in the fitting direction with the inclined surfaces of the depressions 535, whereby the clamping bar 52 is naturally fitted into the proper position. This can prevent the occurrence of a mounting error by the operator. Furthermore, since the identification marks 57, 58 are attached to the clamping bar 52, which of the top clamping surface 521 and the side clamping surface 522 is used at the clamping portion 35 can automatically be determined by capturing the images of the identification marks 57, 58 with the camera 45. Therefore, even though the operator makes an error in mounting the clamping bar 52, the operator can be advised to mount the clamping bar 52 properly by stopping the operation of the screen printer 1 and displaying error information, thereby making it possible to avoid an operation failure and suppress the fabrication of defective products. In addition, it is effective to attach a 2D bar code to the clamping bar 52 in addition to the identification marks 57, 58. This is because it is possible to advise the operator to replace the clamping surface used with a new one by reading the 2D bar code with the camera 45 to manage the number of times of using the clamping surface in the clamping bar 52.

Incidentally, the clamping bar 52 has formed thereon the top clamping surface 521 and the side clamping surface 522 so as to handle the different clamping methods by itself. Alternatively, however, a single clamping bar may have formed thereon clamping surfaces of the same type. Namely, a single clamping bar may have two top clamping surfaces 521 or two side clamping surfaces 522 that are formed thereon. By having the clamping bar configured as described above, even if one of the two clamping surfaces gets so worn that it can no longer be used, the other clamping surface can be used. Thus, since the service life of one clamping member (one clamping bar) is extended, the number of spare parts can be reduced, thereby making it possible not only to reduce the production costs but also to reduce storage space.

Figure 7:
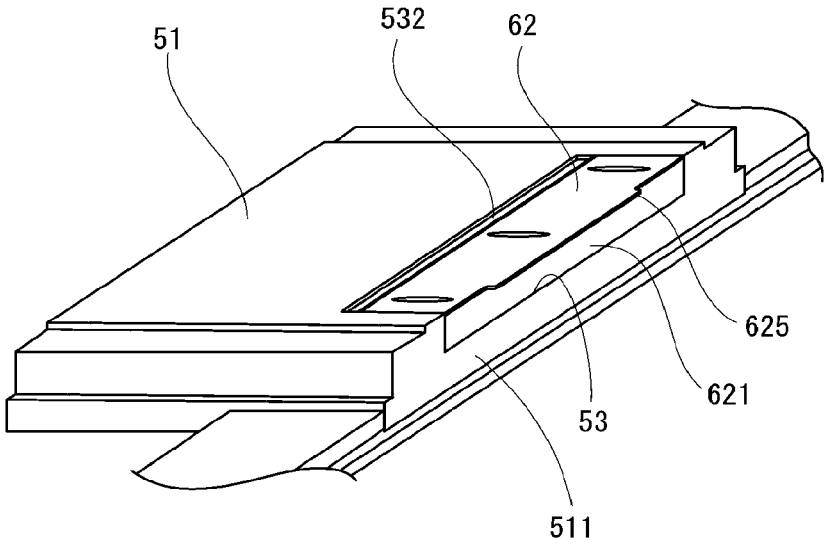
FIG. 7 is a perspective view showing the clamping portion in which a top clamping surface of a clamping bar of an another example is used.

In addition, in the clamping bar 52, the flange portion 525 that makes up the top clamping surface 521 is formed along a full length of the clamping bar 52. This is because the flange portion 525 is formed so as to match the size of the board 10 to be worked on. Then, in the case where the size of the board 10 is reduced, a clamping bar 62 shown in FIG. 7 is used. FIG. 7 is a perspective view showing the clamping portion when the top clamping surface is used. This clamping bar 62 can detachably be mounted in the detachably mounting recessed portion 53 of the base block 51 and is a rod-shaped member having a rectangular cross section that is formed in the same size as that of the clamping bar 52. Then, the clamping bar 62 has a top clamping surface 621 and a side clamping surface 522 (refer to FIG. 4), and a flange portion 625 is formed on an upper surface of the clamping bar 62 so as to protrude towards a top clamping surface 621 side. However, the flange portion 625 is formed not to protrude along a full longitudinal length of the clamping bar 62 but to protrude partially to match a size of a board to be worked on.

This clamping bar 62 has also two modes of use using the top clamping surface, and using the side clamping surface, and the modes of use can easily be converted simply by changing ways of mounting the clamping bar 62 on the base block 51. Thus, the clamping bar 62 provides the same advantageous effect as that provided by the clamping bar 52 described before. Then, in the screen printer 1, although there may be a case where the operator has to remove the board 10, with the clamping bar 62, the removing operation becomes easier than with the clamping bar 52. Namely, in the case of the clamp bar 52, in removing the board 10, it is necessary to be careful in handling the board 10 so that the board 10 is not caught by the long flange portion 525, whereas in the case of the clamping bar 62, the board 10 can be removed more easily by such an extent that the flange portion 625 becomes shorter.

Next, in this embodiment, although the clamping members such as the clamping bars 52, 62 are designed variously so as to extend the service life or to function in the plurality of ways, the clamping bars 52, 62 can both be mounted in the detachably mounting recessed portion 53 of the base block 51. Therefore, the screen printer 1 of this embodiment can handle production of various types of boards with no additional cost involved by preparing the plurality of types of clamping bars.

Figure 9:
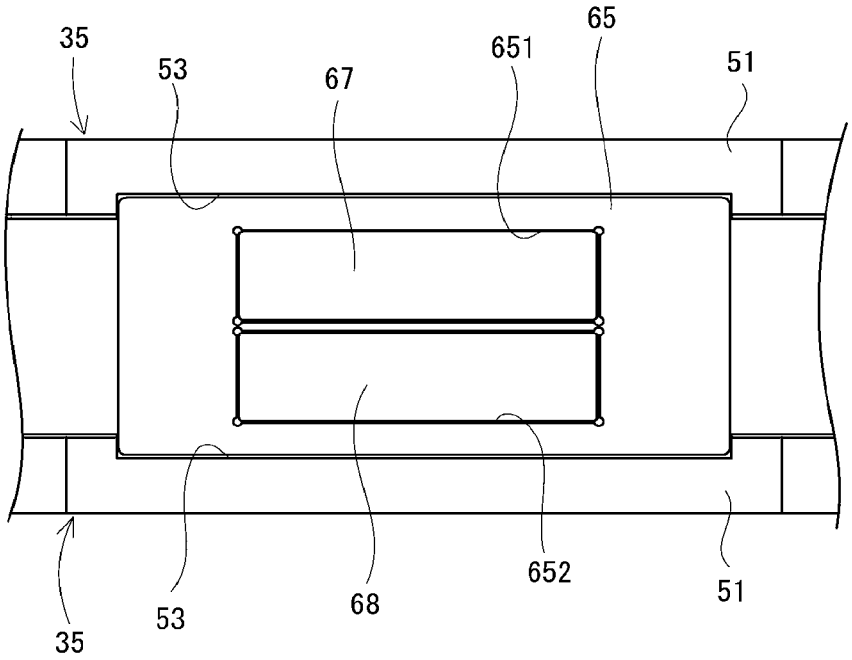
FIG. 9 is a plan view of a clamping portion showing a pattern used when boards are printed individually and separately.

In addition, the screen printer 1 can be used in a different way. A positioning plate can be mounted on the screen printer 1 as shown in FIG. 9 in place of the clamping bars. FIG. 9 is a plan view of an arrangement pattern of the clamping portions when performing individual board printing. In the individual board printing, a plurality of individual boards 67, 68 are conveyed at a time and are pushed up by the backup mechanism so as to be fitted in a positioning plate 65 that is disposed in the clamping portions. The positioning plate 65 has formed therein positioning holes 651, 652 into which the individual boards 67, 68 are fitted, respectively. In the screen printer 1, the positioning plate 65 can be fixed in place in the detachably mounting recessed portions 53 so as to span the space defined between the pair of base blocks 51. The positioning plate 65 is not limited to the configuration in which the plurality of individual boards are pushed up at a time. The positioning plate 65 may have formed therein a single positioning hole so as to handle a case where only one board is conveyed and is then pushed up to fit in the positioning hole.

Thus, while the embodiment of the disclosure has been described heretofore, the disclosure is not limited thereto and hence can be modified variously without departing from the spirit and scope of the disclosure. For example, in the above embodiment, the clamping bars 52, 62 are described as having the two clamping surfaces. However, in case only side clamping surfaces are given to a clamping bar, the clamping bar can include four clamping surfaces.

DESCRIPTION OF REFERENCE NUMERALS

1 . . . Screen printer; 3 . . . board conveyance device; 4 . . . Squeegee device; 5 . . . Clamping device; 6 . . . Lift device; 8 . . . Mask; 10 . . . board; 33, 34 . . . Side frame; 35 . . . Clamping portion; 51 . . . Base block; 52 . . . Clamping bar; 53 . . . Detachably mounting recessed portion; 55 . . . Ball plunger; 57, 58 . . . Identification mark; 521 . . . Top clamping surface; 522 . . . Side clamping surface; 535 . . . depression; 552 . . . Ball

The invention claimed is:

1. A screen printer comprising:

a squeegee that spreads a cream solder over a mask having formed thereon a printing pattern configured of a plurality of through holes to force the cream solder through the printing pattern;

a lift that moves a board with respect to the mask in relation to a vertical direction;

a clamping device for holding the board that is conveyed to be placed under the mask, the clamping device including a pair of clamping portions for holding the board therebetween from a width direction, the pair of clamping portions each including a clamping member brought into abutment with lateral end faces of the board, wherein the clamping member is detachably mounted in a recess of a base block of the clamping device, the clamping member including a top clamping surface and a side clamping surface on a side of the clamping member opposite to the top clamping surface, an upper side of the top clamping surface includes a flange portion, and the clamping member is configured to be mounted in the recess in a first orientation with the top clamping surface flush with an inner surface of the base block and mounted in a second orientation with the side clamping surface flush with the inner surface.

2. The screen printer according to claim 1, wherein the clamping member has identification marks for distinguishing a mount state using the top clamping surface from a mount state using the side clamping surface.

3. The screen printer according to claim 1, wherein the flange portion on the top clamping surface of the clamping member is formed partially or entirely along a longitudinal direction of the top clamping surface.

4. The screen printer according to claim 1, wherein the recess includes a step configured to accommodate the flange portion when the clamping member is mounted in the second orientation.

5. A screen printer comprising:

a squeegee device for spreading a cream solder over a mask having formed thereon a printing pattern configured of a plurality of through holes to force the cream solder through the printing pattern;

a clamping device for holding a board that is conveyed to be placed under the mask; and a lift device for disposing the board with respect to the mask in relation to a vertical direction, wherein the clamping device comprises a pair of clamping portions for holding the board therebetween from a width direction, wherein the pair of clamping portions have individually detachable clamping members that are brought into abutment with lateral end faces of the board, the clamping member has two or more clamping surfaces that are brought into abutment with the board, the clamping member is fitted in a detachably mounting recessed portion formed on a base block in the abutment direction of the board, the clamping member has spherical members provided individually in end portions thereof that are orthogonal to the abutment direction of the board in such a way as to be biased by a biasing member so that spherical surfaces of the spherical members protrude individually from end faces of the end portions, and inclined depressions are formed individually on wall surfaces of the base block that configures the detachably mounting recessed portion and against which the spherical members are caused to abut in such a way that the depressions get deeper as they extend in a fitting direction of the clamping member.

* * * * *